US006453512B1

(12) United States Patent
Kaelin et al.

(10) Patent No.: US 6,453,512 B1
(45) Date of Patent: Sep. 24, 2002

(54) CONTROL BUTTON

(75) Inventors: Laurent Kaelin, Sonvilier; Paolo Pesenti, Bassecourt, both of (CH)

(73) Assignee: Eta SA Fabriques d'Ebauches (SE)

( * ) Notice: Subject to any disclaimer, the term of this patent is extended or adjusted under 35 U.S.C. 154(b) by 55 days.

(21) Appl. No.: 09/661,219

(22) Filed: Sep. 14, 2000

(30) Foreign Application Priority Data

Oct. 19, 1999 (CH) ..... 1904/99

(51) Int. Cl.[7] ..... G04B 27/00

(52) U.S. Cl. ..... 16/441; 368/184; 368/288; 368/306; 368/308; 368/319; 968/31

(58) Field of Search ..... 16/441, 433, DIG. 12, 16/DIG. 30; D10/131; 368/184, 185, 190, 206, 216, 145, 146, 280, 285, 286, 287, 288, 306, 308, 319, 320, 321; 968/31

(56) References Cited

U.S. PATENT DOCUMENTS 3,866,409 A * 2/1975 Tanaka ..... 368/288
3,887,963 A 6/1975 Harmon et al.
5,383,166 A * 1/1995 Gallay ..... 368/288
5,469,758 A 11/1995 Howie, Jr.
5,631,881 A * 5/1997 Pessey et al. ..... 368/319
6,310,835 B1 * 10/2001 Mantoan et al. ..... 368/319

FOREIGN PATENT DOCUMENTS

EP 0 149 970 A1 7/1985

* cited by examiner

*Primary Examiner*—Anthony Knight
*Assistant Examiner*—Doug Hutton
(74) *Attorney, Agent, or Firm*—Richard K. Robinson

(57) ABSTRACT

Control button having a metal body (10) provided along its axis with a blind hole (16) closed by a cap (18) and extended by a wall (14) of revolution. The body (10) includes a groove (20) made in the outer surface of the wall (14) and channels (26) connecting said surface to the inside of the blind hole (16). The button further includes a fitting (12) made of synthetic material, formed of a ring (28) closing the groove and extended radially by raised portions (34) as far as the openings of the channels (26) in the wall (14) of a radial structure with several branches (30) closing the channels (26), and a core (32) connecting the branches (30) to secure between them the different parts (28, 30, 32, 34) of the fitting (12).

4 Claims, 3 Drawing Sheets

CONTROL BUTTON

The present invention relates to rotating control buttons, of the type used for example in watches and commonly called time-setting crowns. It concerns more particularly a button including a metal body, of generally cylindrical shape, and provided with a blind hole intended to accommodate a control stem.

Such buttons, made of metal, are well known to those skilled in the art. They are fitted to most watches provided with hands. They allow time-setting, and winding for mechanical watches. The user must thus be able to pull out the button to select a function and rotate it in order to modify a value.

In order to facilitate the rotation of the button, the latter may most often include grooves on the cylindrical portion of its external surface. Unfortunately such grooves are abrasive, tend to wear out clothes, and do not always allow a good grip in particular as regards traction.

It is well known that organic materials, such as rubber, allow greater adherence than metal, without however causing wear. These materials are, however, too lacking in rigidity to be able to be the only constituent material of a control button.

In order to have a control button having, during use, the advantages of metal and rubber, it seems natural to coat the grooves with a synthetic material. This solution has numerous drawbacks. The metal surface has to be pre-treated to allow a synthetic material to adhere thereto, said treatment having to be adapted to each type of material; it is very difficult to delimit very precisely the covered zones so that it is very often necessary to do a finishing machining operation such as polishing; since the thickness of synthetic material deposited is very small the coating is liable to wear and accidental tearing.

The present invention mainly concerns a button made of two metal/synthetic materials so that it does not have the drawbacks of the aforecited prior art.

The invention thus concerns a control button having a metal body 10, 52 provided along its axis A—A with a blind hole 16, 58 closed by a cap 18 extended by a wall 14 of revolution, said button including on all or part of the exterior of its wall 14 a gripping zone made of synthetic material, characterised in that body 10, 52 of the button includes an annular groove 20, 62 made in the outer surface of its wall 14, 56 in proximity to the opening of blind hole 16, 58 and channels 26 connecting said outer surface of wall 14 and the bottom of blind hole 16, 58, and in that a fitting 12 made of synthetic material 12 is made in situ to form a ring 22, 64 housed in groove 20, 62 and whose raised portions 34 extend along axis A—A over the outer surface of wall 14, 56 at least as far as the openings of channels 26, a radial structure with several branches 30 closing said channels 26 and a core 32 connecting said branches 30 to secure between them the different parts of fitting 12.

Consequently, the fitting forms on the exterior of the body portions in relief which facilitate gripping, and on the interior loops, each of them gripping the metal body, which allows the best possible fastening conditions.

In order to facilitate the driving in rotation of the control button, the portions of the synthetic fitting in relief define raised portions connecting the ring to the branches, or an annular ring provided with grooves.

In certain applications, for example when the button according to the invention is used as the time-setting crown of a watch, it is subjected to traction efforts. If this effort is exerted frequently on the synthetic material, this may result in premature wear, able to cause it to be torn off. This is why it is advantageous for the necessary effort to be applied to the metal body. For this purpose, the latter has a ring defining the side of the groove in proximity to the opening of the blind hole.

For the aforementioned application, the crown is often required to participate in the water-resistant sealing of the watch. Generally, the interior of the cylindrical wall is provided with an O-ring gasket co-operating with a part of the case to close, in a water-resistant manner, the opening through which the control means of the watch pass. This O-ring gasket slides into a housing in the crown.

Another object of the present invention is to make a control button wherein the gripping fitting made of synthetic material also forms a sealing gasket. Therefore, and in another particular embodiment, the button according to the invention is characterised in that its fitting extending through additional channels inside the blind hole has an O-ring structure attached to the inner wall of the blind hole to form a sealing gasket.

Other advantages and features of the invention will appear from the following description, made with reference to the annexed drawings, in which.

Figure 2:
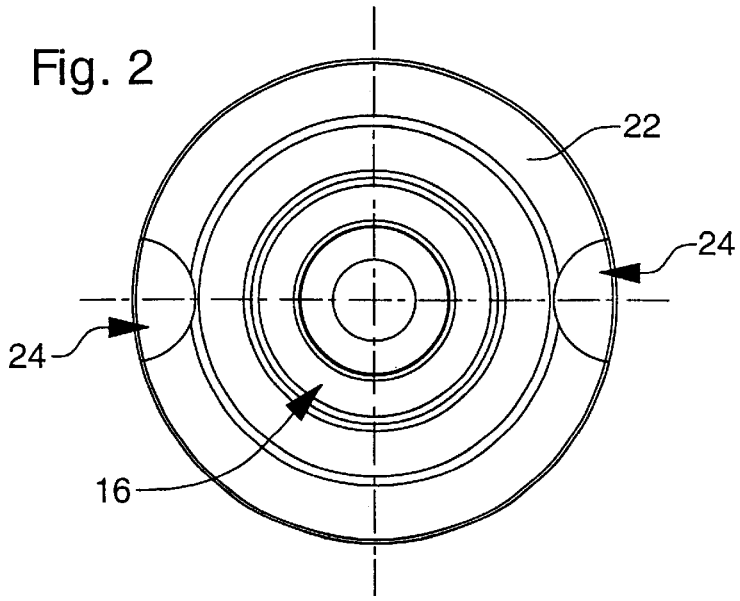
FIG. 2 is a bottom view of the button of FIG. 1.
Figure 1:
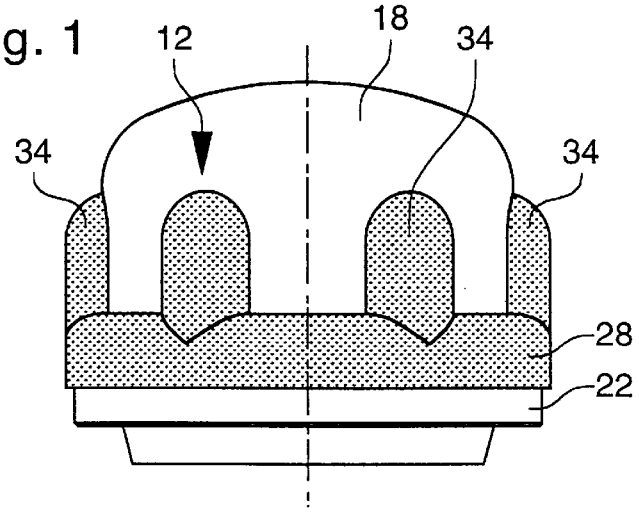
FIG. 1 is a side view of a button according to a first embodiment.
Figure 3:
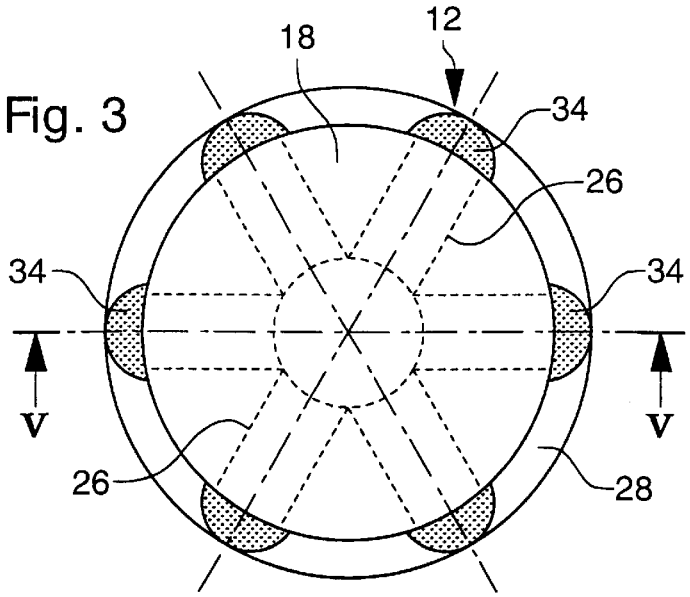
FIG. 3 is a top view of the button of FIG. 1.
Figure 4:
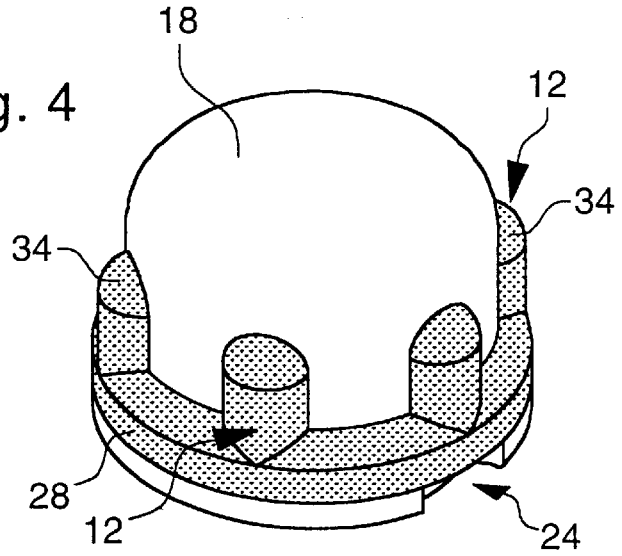
FIG. 4 is a perspective view of the button of FIG. 1.
Figure 5:
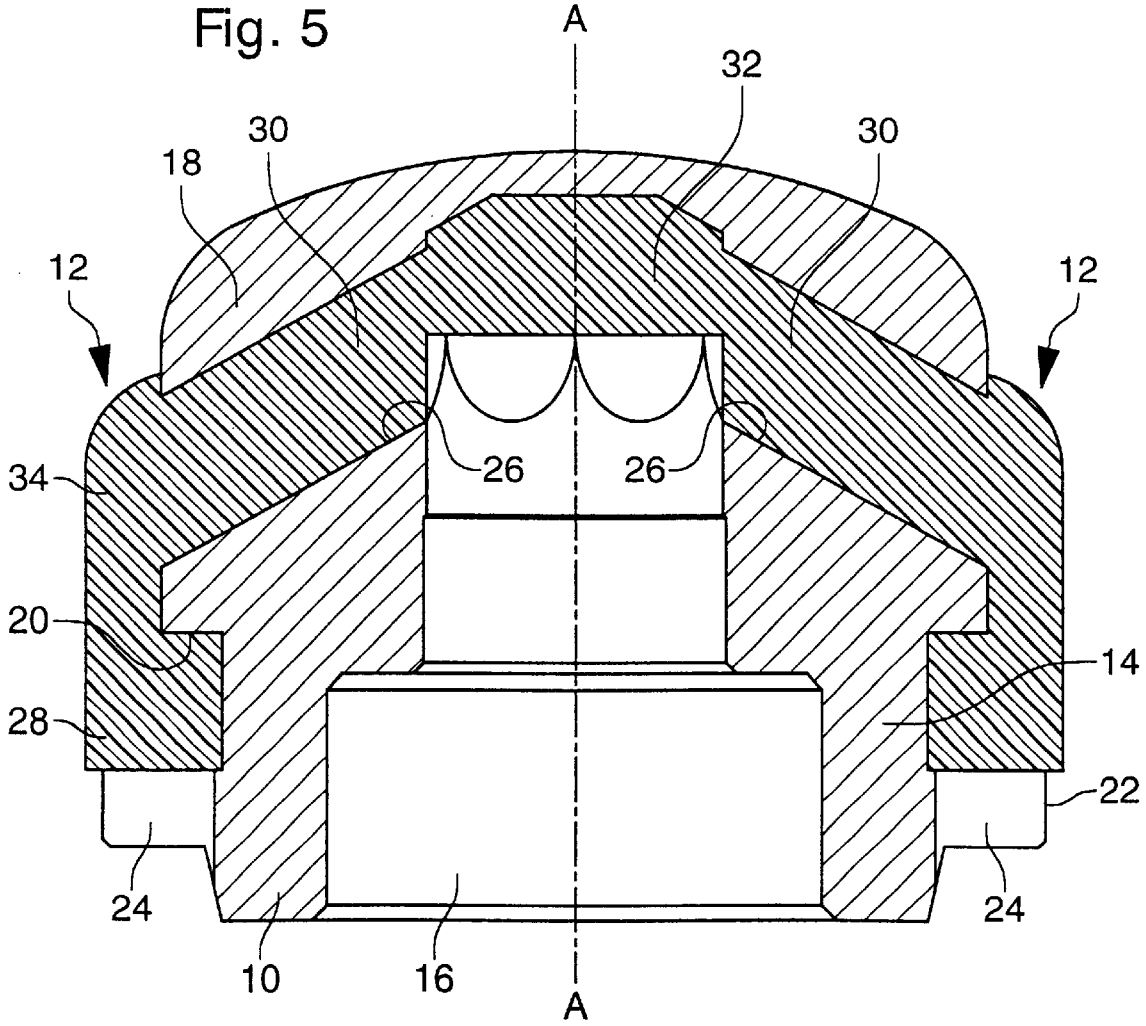
FIG. 5 is a cross-section along the line V—V of FIG. 3.

The button shown in FIGS. 1 to 5 is a time-setting crown for a watch, essentially including a body 10, made of metal, and a fitting 12 made of synthetic material.

Body 10 is made of stainless steel or brass coated with a protective metal layer. It includes a wall 14, of generally cylindrical shape, whose inner surface defines a blind hole 16 and a cap 18 closing hole 16 at one of its ends. Hole 16 is arranged to accommodate a control stem which is not shown in the drawings.

Wall 14 is provided on the exterior with an annular groove 20, one side of which, arranged in proximity to the end including the opening of hole 16, is formed of a ring 22 having two diametrically opposite recesses 24, in a semicircle and made over the entire thickness of ring 22. Wall 14 is also pierced with six radial channels 26 which are regularly distributed and open into hole 16, inclined by approximately 60° with respect to axis A—A and defining a core junction 32 the top of which is located in cap 18.

Fitting 12 is made of a flexible synthetic material having a high friction coefficient when it is in contact with the user's skin. This synthetic material is for example polyurethane. The fitting is formed of a ring 28 housed in groove 20, a radial structure with six branches 30, closing channels 26 and the inner ends of which are connected by junction core 32, and six raised portions 34 each connecting one of branches 30 to ring 28. It is clear that, if one wishes to have more or less than six raised portions 34, an equal number of radial channels 26 also have to be made.

The manufacture of a button as described is achieved by overmoulding, by means of a mould formed of two removable shells, including several identical moulds, intended to receive body 10 and shaped in a hollow at the definitive outer surface of the button made of two materials. Each of them is connected on the one hand to an injection channel, and on the other hand to an outflow channel, bodies 10 being arranged so that these channels, oriented substantially parallel to axis A—A open into recesses 24. When the shells are assembled, each mould defines a volume exactly corresponding to the final volume of the button. Also, when the synthetic material is injected, it penetrates groove 20, to form ring 28, over sectors of wall 14 to form raised portions 34, and inside channels 26 to define branches 30 and core 32, the surplus flowing in to the outflow channel.

It is clear that, during this operation, an end portion of the blind hole is blocked by a plug, secured to one of the shells, so as to prevent any penetration of synthetic material into this space, with the exception of core 32. The latter assures a narrow link between branches 30, so that synthetic fitting 12 forms a whole, including a set of closed loops, each gripping a part of body 10. Consequently and although polyurethane does not adhere to metal, the button thereby made forms a solid whole.

After the injection operation, the buttons are removed from the mould, connected to each other by a sprue formed of the material contained in the injection and outflow channels, then separated from each other by cutting the superfluous material. As the sprues are connected to the fittings of each button in the zones including recesses 24, as a result, the cutting occurs at a point which is masked after being set in place in the middle part of the watch.

In order to correct the data of the watch fitted with a button as described hereinbefore, it is generally necessary to pull it before rotating it. In order to pull, the user takes hold of the button in the part thereof opposite to cap 18, namely in proximity to ring 22. Since the latter is made of metal, there is no risk of the apparent parts of fitting 12 being torn off or damaged.

The button which has just been described with reference to FIGS. 1 to 5 has raised portions 34 facilitating the driving thereof in rotation and giving it a certain aesthetic appearance in addition to its functional nature. In a variant, not shown in the drawings, groove 20 may be enlarged until the outer openings of channels 26 are integrated. Consequently, practically all the outer part of wall 14 is covered with synthetic material, with the exception of ring 22, which gives the watch an original appearance.

Figure 6:
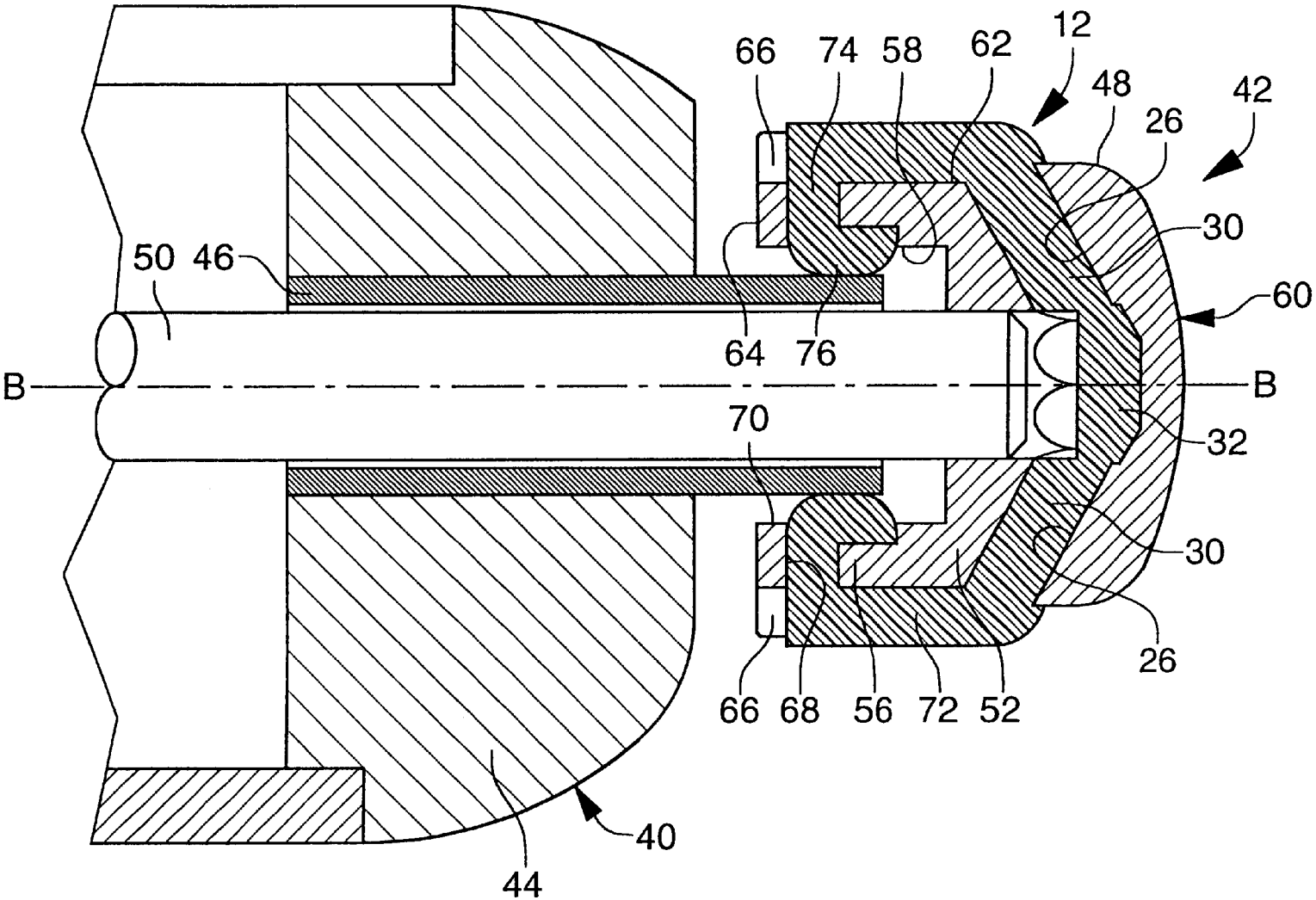
FIG. 6 is a cross-section of a portion of a watch case provided with a time-setting crown corresponding to a second embodiment of the button according to the invention.

According to another embodiment of the invention, FIG. 6 shows, in cross-section, a watch case 40 provided with control means 42 for setting the display time.

Case 40 includes a middle part 44 bearing a cylindrical tube 46, of axis B—B, inside which are housed control means 42. The latter are formed of a crown 48 and a time-setting stem 50, secured in the crown by known means, for example by bonding or by being driven in.

Crown 48 includes a body 52, made of metal, and a gripping fitting 54, made of synthetic material. Body 52 is formed, in an identical manner to body 10, of a cylindrical wall 56 defining a blind hole 58, the latter being blocked, at one of its ends, by a cap 60. Wall 56 is provided, on its outer face, with an annular groove 62 one side of which, adjacent to the opening of hole 58, is defined by a ring 64 provided with two diametrically opposite recesses 66, in a semi-circle and made in the entire thickness of ring 64.

Wall 56 is pierced with channels 68 extending radially in its entire thickness and consequently opening into blind hole 58. It further includes an edge 70 arranged at the entry to hole 58 and extending radially towards axis B—B.

Fitting 54 includes an annular strip 72 housed in groove 62 which then extends radially in the direction of cap 18, junction elements 74 closing channels 68 and an O-ring structure 76 adjacent to edge 70. This O-ring structure 76 extends inside wall 56, beyond channels 68 in the direction of cap 60. In this portion, its inner diameter is slightly less than the outer diameter of tube 46, so that O-ring structure 76 is compressed, abutting against tube 46 and wall 56, thus assuring the sealing gasket function. It is consequently possible, in a single operation, to have a water-resistant time-setting crown whose driving in rotation is facilitated by the outer part of the synthetic gasket.

As shown in FIG. 6, the cohesion of the gasket may be further increased by providing, as in the first embodiment, radial channels 26 in which the gasket forms branches 30 joining annular strip 72 and core 32. As can be understood, the necessity of forming branches 30 and core 32 depends essentially on the greater or lesser elasticity of the synthetic material used and the thickness given to annular strip 72.

The two embodiment examples of a control button according to the invention relate to a watch crown. It is clear that this type of button can be used on other applications requiring control means of small dimensions, which are robust and easy to handle like, for example, portable measuring apparatus, communication apparatus, etc.

The fitting may, of course, be made of a different material to polyurethane. A material which is pleasant to touch, stable and wear resistant will be chosen.

What is claimed is:

1. A control button, comprising:

a metal body, said body having:

a blind hole along the button axis (A—A), said hole closed by a cap at a top end of said hole, said cap extended by a circular wall;

an annular groove located in the outer surface of said wall, said groove located in proximity to the opening of said hole; and channels connecting the outer surface of said wall and the top of said hole; and a fitting made of synthetic materials, said fitting defining a gripping zone and including:

raised portions extending along the button axis (A—A) over the outer surface of said wall, said portions extending at least as far as the openings of the channels; and a radial structure, said structure including several branches located inside said channels and a core connecting said branches to each other.

2. A control button according to claim 1, wherein said body includes passages through the wall in proximity of the groove, said passages allowing the fitting to pass through to form an O-ring structure defining a sealing gasket inside the blind hole.

3. The control button according to claim 1, where the gripping zone is on all of the exterior of the wall of the control button.

4. The control button according to claim 3, wherein said body includes passages through the wall in proximity of the groove, said passages allowing the fitting to pass through to form an O-ring structure defining a sealing gasket inside the blind hole.

* * * * *